US009872343B2

(12) United States Patent
Parsche

(10) Patent No.: US 9,872,343 B2
(45) Date of Patent: Jan. 16, 2018

(54) RADIO FREQUENCY HEATING OF PETROLEUM ORE BY PARTICLE SUSCEPTORS

(71) Applicant: HARRIS CORPORATION, Melbourne, FL (US)

(72) Inventor: Francis Eugene Parsche, Palm Bay, FL (US)

(73) Assignee: HARRIS CORPORATION, Melbourne, FL (US)

( * ) Notice: Subject to any disclaimer, the term of this patent is extended or adjusted under 35 U.S.C. 154(b) by 258 days.

(21) Appl. No.: 14/705,182

(22) Filed: May 6, 2015

(65) Prior Publication Data

US 2015/0237681 A1 Aug. 20, 2015

Related U.S. Application Data

(62) Division of application No. 12/395,995, filed on Mar. 2, 2009, now Pat. No. 9,034,176.

(51) Int. Cl.
*C10G 1/00* (2006.01)
*H05B 6/10* (2006.01)

(52) U.S. Cl.
CPC ..... *H05B 6/106* (2013.01)

(58) Field of Classification Search
CPC ..... C10G 1/00
See application file for complete search history.

(56) References Cited

U.S. PATENT DOCUMENTS

| | | | | |
|---|---|---|---|---|
| 2,371,459 | A | 3/1945 | Mittelmann | |
| 2,411,198 | A | 11/1946 | Eltgroth | |
| 2,597,276 | A | 5/1952 | Altmann | |
| 2,685,930 | A | 8/1954 | Albaugh | |
| 2,756,313 | A | 7/1956 | Cater | |
| 2,871,477 | A | 1/1959 | Hatkin | |
| 2,947,841 | A | 8/1960 | Pickles | |
| 3,497,005 | A | 2/1970 | Pelopsky | |
| 3,848,671 | A | 11/1974 | Kern | |
| 3,944,910 | A | 3/1976 | Rau | |
| 3,954,140 | A | 5/1976 | Hendrick | |
| 3,988,036 | A | 10/1976 | Fisher | |
| 3,991,091 | A | 11/1976 | Driscoll | |
| 4,035,282 | A | 7/1977 | Stuchberry et al. | |
| 4,042,487 | A * | 8/1977 | Seguchi | B01J 19/087 204/155 |
| 4,087,781 | A | 5/1978 | Grossi et al. | |
| 4,136,014 | A | 1/1979 | Vermeulen | |
| 4,140,179 | A | 2/1979 | Kasevich et al. | |
| 4,140,180 | A | 2/1979 | Bridges et al. | |
| 4,144,935 | A | 3/1979 | Bridges | |
| 4,146,125 | A | 3/1979 | Sanford et al. | |
| 4,196,329 | A | 4/1980 | Rowland et al. | |
| 4,295,880 | A | 10/1981 | Horner | |
| 4,300,219 | A | 11/1981 | Joyal | |
| 4,301,865 | A | 11/1981 | Kasevich et al. | |
| 4,328,324 | A | 5/1982 | Kock | |
| 4,373,581 | A | 2/1983 | Toellner | |
| 4,396,062 | A | 8/1983 | Iskander | |
| 4,404,123 | A | 9/1983 | Chu | |
| 4,410,216 | A | 10/1983 | Allen | |
| 4,425,227 | A | 1/1984 | Smith | |
| 4,449,585 | A | 5/1984 | Bridges et al. | |
| 4,456,065 | A | 6/1984 | Heim | |
| 4,457,365 | A | 7/1984 | Kasevich et al. | |
| 4,470,459 | A | 9/1984 | Copland | |
| 4,485,869 | A | 12/1984 | Sresty | |
| 4,487,257 | A | 12/1984 | Dauphine | |
| 4,508,168 | A | 4/1985 | Heeren | |
| 4,514,305 | A | 4/1985 | Filby | |
| 4,524,827 | A | 6/1985 | Bridges | |
| 4,531,468 | A | 7/1985 | Simon | |
| 4,583,586 | A | 4/1986 | Fujimoto et al. | |

(Continued)

FOREIGN PATENT DOCUMENTS

| | | |
|---|---|---|
| CA | 1199573 | 1/1986 |
| CA | 2678473 | 8/2009 |
| DE | 102008022176 | 11/2009 |
| EP | 0135966 | 4/1985 |
| EP | 0418117 | 3/1991 |
| EP | 0563999 | 10/1993 |
| EP | 1106672 | 6/2001 |
| FR | 1586066 | 2/1970 |
| FR | 2925519 | 6/2009 |
| JP | 56050119 | 5/1981 |
| JP | 2246502 | 10/1990 |
| WO | 2007133461 | 11/2007 |
| WO | 2008011412 | 1/2008 |

(Continued)

OTHER PUBLICATIONS

FR 2925519 A1 (Jun. 26, 2009), Dath et al. (English translation).*

(Continued)

*Primary Examiner* — Randy Boyer

(74) *Attorney, Agent, or Firm* — Allen, Dyer, Doppelt + Gilchrist, P.A. Attorneys at Law

(57) ABSTRACT

A method for heating materials by application of radio frequency ("RF") energy is disclosed. For example, the disclosure concerns a method for RF heating of petroleum ore, such as bitumen, oil sands, oil shale, tar sands, or heavy oil. Petroleum ore is mixed with a substance comprising susceptor particles that absorb RF energy. A source is provided which applies RF energy to the mixture of a power and frequency sufficient to heat the susceptor particles. The RF energy is applied for a sufficient time to allow the susceptor particles to heat the mixture to an average temperature greater than about 212° F. (100° C.). Optionally, the susceptor particles can be removed from the mixture after the desired average temperature has been achieved. The susceptor particles may provide for anhydrous processing, and temperatures sufficient for cracking, distillation, or pyrolysis.

18 Claims, 2 Drawing Sheets

(56) References Cited

U.S. PATENT DOCUMENTS 4,620,593 A 11/1986 Haagensen
4,622,496 A 11/1986 Dattili
4,645,585 A 2/1987 White
4,678,034 A 7/1987 Eastlund
4,703,433 A 10/1987 Sharrit
4,704,581 A 11/1987 Clark
4,790,375 A 12/1988 Bridges
4,817,711 A 4/1989 Jeambey
4,882,984 A 11/1989 Eves, II
4,892,782 A 1/1990 Fisher et al.
4,968,726 A 11/1990 Thorsrud
4,975,164 A 12/1990 Ravella et al.
5,046,559 A 9/1991 Glandt
5,055,180 A 10/1991 Klaila
5,065,819 A 11/1991 Kasevich
5,082,054 A 1/1992 Kiamanesh
5,136,249 A 8/1992 White
5,198,826 A 3/1993 Ito
5,199,488 A 4/1993 Kasevich
5,233,306 A 8/1993 Misra
5,236,039 A 8/1993 Edelstein
5,251,700 A 10/1993 Nelson
5,293,936 A 3/1994 Bridges
5,304,767 A 4/1994 MacGaffigan
5,315,561 A 5/1994 Grossi
5,370,477 A 12/1994 Bunin
5,378,879 A 1/1995 Monovoukas
5,506,592 A 4/1996 MacDonald
5,582,854 A 12/1996 Nosaka
5,621,844 A 4/1997 Bridges
5,631,562 A 5/1997 Cram
5,746,909 A 5/1998 Calta
5,910,287 A 6/1999 Cassin
5,923,299 A 7/1999 Brown et al.
6,045,648 A 4/2000 Palmgren et al.
6,046,464 A 4/2000 Schetzina
6,055,213 A 4/2000 Rubbo
6,063,338 A 5/2000 Pham
6,097,262 A 8/2000 Combellack
6,106,895 A 8/2000 Usuki
6,110,359 A 8/2000 Davis
6,112,273 A 8/2000 Kau
6,184,427 B1 * 2/2001 Klepfer ..... C10G 1/10 201/2.5
6,229,603 B1 5/2001 Coassin
6,232,114 B1 5/2001 Coassin
6,301,088 B1 10/2001 Nakada
6,303,021 B2 10/2001 Winter
6,348,679 B1 2/2002 Ryan et al.
6,360,819 B1 3/2002 Vinegar
6,432,365 B1 8/2002 Levin
6,501,056 B1 12/2002 Hirohata
6,531,881 B1 3/2003 Cordes
6,603,309 B2 8/2003 Forgang
6,613,678 B1 9/2003 Sakaguchi
6,614,059 B1 9/2003 Tsujimura
6,626,251 B1 9/2003 Sullivan
6,649,888 B2 11/2003 Ryan et al.
6,712,136 B2 3/2004 De Rouffignac
6,808,935 B2 10/2004 Levin
6,831,470 B2 12/2004 Xie
6,856,140 B2 2/2005 Talanov
6,886,632 B2 5/2005 Raghuraman
6,923,273 B2 8/2005 Terry
6,932,155 B2 8/2005 Vinegar
6,967,589 B1 11/2005 Peters
6,992,630 B2 1/2006 Parsche
7,046,584 B2 5/2006 Sorrells
7,079,081 B2 7/2006 Parsche et al.
7,091,460 B2 8/2006 Kinzer
7,109,457 B2 9/2006 Kinzer
7,115,847 B2 10/2006 Kinzer
7,147,057 B2 12/2006 Steele
7,172,038 B2 2/2007 Terry
7,205,947 B2 4/2007 Parsche
7,312,428 B2 12/2007 Kinzer
7,322,416 B2 1/2008 Burris, II
7,337,980 B2 3/2008 Schaedel
7,438,807 B2 10/2008 Garner et al.
7,441,597 B2 10/2008 Kasevich
7,461,693 B2 12/2008 Considine et al.
7,484,561 B2 2/2009 Bridges
7,562,708 B2 7/2009 Cogliandro
7,623,804 B2 11/2009 Sone
7,631,691 B2 12/2009 Symington
7,639,016 B2 12/2009 Forgang
7,665,355 B2 2/2010 Zhang
7,694,829 B2 4/2010 Veltri
7,752,906 B2 7/2010 Pop
7,775,099 B2 8/2010 Bogath
8,047,285 B1 11/2011 Smith
8,101,068 B2 1/2012 White et al.
8,120,369 B2 2/2012 Hernandez et al.
8,128,786 B2 3/2012 White et al.
8,133,384 B2 3/2012 Parsche
8,494,775 B2 7/2013 Parsche
8,674,274 B2 3/2014 Parsche
8,729,440 B2 5/2014 Parsche
8,887,810 B2 11/2014 Parsche
2002/0032534 A1 3/2002 Regier
2004/0031731 A1 * 2/2004 Honeycutt ..... C10G 1/00 208/402
2005/0199386 A1 9/2005 Kinzer
2005/0274513 A1 12/2005 Schultz
2006/0038083 A1 2/2006 Criswell
2007/0108202 A1 5/2007 Kinzer
2007/0131591 A1 6/2007 Pringle
2007/0137852 A1 6/2007 Considine et al.
2007/0137858 A1 6/2007 Considine et al.
2007/0176842 A1 8/2007 Brune
2007/0187089 A1 8/2007 Bridges
2007/0261844 A1 11/2007 Cogliandro et al.
2008/0073079 A1 3/2008 Tranquilla et al.
2008/0111096 A1 5/2008 Veltri
2008/0135244 A1 6/2008 Miller
2008/0143330 A1 6/2008 Madio
2009/0009410 A1 1/2009 Dolgin et al.
2009/0242196 A1 10/2009 Pao
2011/0140702 A1 6/2011 Bloemenkamp
2011/0248900 A1 10/2011 De Rochemont
2012/0067580 A1 3/2012 Parsche

FOREIGN PATENT DOCUMENTS

WO 2008030337 3/2008
WO 2008098850 8/2008
WO 2009027262 8/2008
WO 2009114934 9/2009

OTHER PUBLICATIONS

Chute, F.S., Vermeulen, F.E., Cervenan, M.R. and McVea, F.J., "Electrical Properties of Athabasca Oil Sands", Canadian Journal of Earth Science, 16, 1979, pp. 2009-2021.

Davidson, R.J., "Electromagnetic Stimulation of Lloydminster Heavy Oil Reservoirs", Journal of Canadian Petroleum Technology, 34(4), 1995, pp. 15-24.

Hu, Y., Jha, K.N. and Chakma, A., "Heavy-Oil Recovery from Thin Pay Zones by Electromagnetic Heating", Energy Sources, 21(1-2), 1999, pp. 63-73.

Kasevich, R.S., Price, S.L., Faust, D.L. and Fontaine, M.F., "Pilot Testing of a Radio Frequency Heating System for Enhanced Oil Recovery from Diatomaceous Earth", SPE28619, presented at the SPE 69th Annual Technical Conference and Exhibition held in New Orleans LA, USA, Sep. 25-28, 1994, pp. 1-15.

Koolman, M., Huber, N., Diehl, D. and Wacker, B., "Electromagnetic Heating Method to Improve Steam Assisted /N.B./ 23 Gravity Drainage", SPE117481, presented at the 2008 SPE International Thermal Operations and Heavy Oil Symposium held in Calgary, Alberta, Canada, Oct. 20-23, 2008, pp. 1-13.

Kovaleva, L.A., Nasyrov, N.M. and Khaidar, A.M., Mathematical Modelling of High-Frequency Electromagnetic Heating of the Bot-

(56) References Cited

OTHER PUBLICATIONS tom-Hole Area of Horizontal Oil Wells, Journal of Engineering Physics and Thermo Physics, 77(6), 2004, pp. 1184-1191.
McGee, B.C.W. and Donaldson, RD., "Heat Transfer Fundamentals for Electro-thermal Heating of Oil Reservoirs", CIPC 2009-024, presented at the Canadian International Petroleum Conference, held in Calgary, Alberta, Canada, Jun. 16-18, 2009, pp. 1-16.
Ovalles, C., Fonseca, A., Lara, A., Alvarado, V., Urrecheaga, K., Ranson, A. and Mendoza, H., "Opportunities of Downhole Dielectric Heating in Venezuela: Three Case Studies Involving Medium, Heavy and Extra-Heavy Crude Oil D Reservoirs" 5PE78980, presented at the 2002 SPE International Thermal Operations and Heavy Oil Symposium and International Horizontal Well Technology Conference held in Calgary, Alberta, Canada, Nov. 4-7, 2002, pp. 1-10.
Rice, S.A., Kok, A.L. and Neate, C.J., "A Test of the Electric Heating Process as a Means of Stimulating the 27 Productivity of an Oil Well in the Schoonebeek Field", CIM 92-04 presented at the CIM 1992 Annual Technical Conference in Calgary, Jun. 7-10, 1992, pp. 1-16.
Sahni, A. and Kumar, M. "Electromagnetic Heating Methods for Heavy Oil Reservoirs", SPE62550, presented at the 2000 SPE/AAPG Western Regional Meeting held in Long Beach, California, Jun. 19-23, 2000, pp. 1-10.
Sayakhov, F.L., Kovaleva, L.A. and Nasyrov, N.M., "Special Features of Heat and Mass Exchange in the Face Zone of /N.B./ 29 Boreholes upon Injection of a Solvent with a Simultaneous Electromagnetic Effect", Journal of Engineering Physics and Thermophysics, 71(1), 1998, pp. 161-165.
Spencer, H.L., Bennett, K.A. and Bridges, J.E. "Application of the IITRI/Uentech Electromagnetic Stimulation Process iN.B.i 30 to Canadian Heavy Oil Reservoirs" Paper 42, Fourth International Conference on Heavy Oil Crude and Tar Sands, UNITARIUNDP, Edmonton, Alberta, Canada, Aug. 7-12, 1988, pp. 1-8.
Sresty, G.C., Dev, H., Snow, R.H. and Bridges, J.E., "Recovery of Bitumen from Tar Sand Deposits with the Radio Frequency Process", SPE Reservoir Engineering, Jan. 1986, pp. 85-94.
Vermulen, F. and McGee, B.C.W., "In Situ Electromagnetic Heating for Hydrocarbon Recovery and Environmental Remediation", Journal of Canadian Petroleum Technology, Distinguished Author Series, 39(8), 2000, pp. 25-29.
Schelkunoff, S.K. and Friis, H.T., "Antennas: Theory and Practice", John Wiley & Sons, Inc., London, Chapman Hall, Limited, 1952, pp. 229-244, 351-353.
Gupta, S.C., Gittins, S.D., "Effect of Solvent Sequencing and Other Enhancement on Solvent Aided Process", Journal of Canadian Petroleum Technology, vol. 46, No. 9, Sep. 2007, pp. 57-61.
Folke Engelmark, Time-Lapse Monitoring of Steam Assisted Gravity Drainage (SAGO) of Heavy Oil Using Multi-Transient Electro-Magnetics (MTEM), CSPG CSEG Convention, 2007, pp. 647-651.
PCT Notification of Transmittal of the International Search Report and the Written Opinion of the International Searching Authority, or the Declaration, in PCT/US2010/025761, dated Feb. 9, 2011, pp. 1-13.
PCT Notification of Transmittal of the International Search Report and the Written Opinion of the International Searching Authority, or the Declaration, in PCT/US2010/057090, dated Mar. 3, 2011, pp. 1-10.
"Control of Hazardous Air Pollutants From Mobile Sources", U.S. Environmental Protection Agency, Mar. 29, 2006. p. 15853 (http://www.epa.gov/EPA-AIR/2006/March/Day-29/a2315b.htm), pp. 1-13.
Von Hippel, Arthur R., Dielectrics and Waves, Copyright 1954, Library of Congress Catalog Card No. 54-11020, Contents, pp. xi-xii; Chapter II, Section 17, "Polyatomic Molecules", Appendix C-E, New York, John Wiley and Sons, pp. 150-155, pp. 273-277.
United States Patent and Trademark Office, Non-final Office action issued in U.S. Appl. No. 12/396,247, dated Mar. 28, 2011, pp. 1-10.
United States Patent and Trademark Office, Non-final Office action issued in U.S. Appl. No. 12/396,284, dated Apr. 26, 2011, pp. 1-62.
Patent Cooperation Treaty, Notification of Transmittal of the International Search Report and the Written Opinion of the International Searching Authority, or the Declaration, in PCT/US201 0/025808, dated Apr. 5, 2011, pp. 1-12.
Deutsch, C.V., McLennan, J.A., "The Steam Assisted Gravity Drainage (SAGD) Process," Guide to SAGD (Steam Assisted Gravity Drainage) Reservoir Characterization Using Geostatistics, Centre for Computational Statistics (CCG), Guidebook Series, 2005, vol. 3; p. 2, section 1.2, published by Centre for Computational Statistics, Edmonton, AB, Canada, pp. 1-14.
Marcuvitz, Nathan, Waveguide Handbook; 1986; Institution of Engineering and Technology, vol. 21 of IEE Electromagnetic Wave series, ISBN 0863410588, Chapter 1, pp. 1-54, published by Peter Peregrinus Ltd. on behalf of the Institution of Electrical Engineers, © 1986, pp. 1-57.
Marcuvitz, Nathan, Waveguide Handbook; 1986; Institution of Engineering and Technology, vol. 21 of IEE Electromagnetic Wave series, ISBN 0863410588, Chapter 2.3, pp. 66-72, published by Peter Peregrinus Ltd. on behalf of the Institution of Electrical Engineers, © 1986. pp. 1-10.
"Oil sands." Wikipedia, the free encyclopedia. Retrieved from the Internet from: http://en.wikipedia.org/w/index.php?title=Oil_sands&printable=yes, Feb. 16, 2009, pp. 1-14.
Sahni et al., "Electromagnetic Heating Methods for Heavy Oil Reservoirs." 2000 Society of Petroleum Engineers SPE/AAPG Western Regional Meeting, Jun. 19-23, 2000, pp. 1-12.
Power et al., "Froth Treatment: Past, Present & Future." Oil Sands Symposium, University of Alberta, May 3-5, 2004, pp. 1-29.
Flint, "Bitumen Recovery Technology A Review of Long Term R&D Opportunities." Jan. 31, 2005. LENEF Consulting (1994) Limited, Part 1, 100 pp. Part 2, 110 pgs.
"Froth Flotation." Wikipedia, the free encyclopedia. Retrieved from the Internet from: http://en.wikipedia.org/wiki/Froth_flotation, Apr. 7, 2009, pp. 1-6.
"Relative static permittivity." Wikipedia, the free encyclopedia. Retrieved from the Internet from http://en.wikipedia.org/w/index/php?title=Relative_static_permittivity&printable=yes, Feb. 12, 2009, pp. 1-3.
"Tailings." Wikipedia, the free encyclopedia. Retrieved from the Internet from http://en.wikipedia.org/w/index.php?title=Tailings&printable=yes, Feb. 12, 2009, pp. 1-6.
"Technologies for Enhanced Energy Recovery" Executive Summary, Radio Frequency Dielectric Heating Technologies for Conventional and Non-Conventional Hydrocarbon-Bearing Formulations, Quasar Energy, LLC, Sep. 3, 2009, pp. 1-6.
Burnhan, "Slow Radio-Frequency Processing of Large Oil Shale Volumes to Produce Petroleum-like Shale Oil," U.S. Department of Energy, Lawrence Livermore National Laboratory, Aug. 20, 2003, UCRL-ID-155045, pp. 1-17.
Sahni et al., "Electromagnetic Heating Methods for Heavy Oil Reservoirs," U.S. Department of Energy, Lawrence Livermore National Laboratory, May 1, 2000, UCL-JC-138802, pp. 1-10.
Abernethy, "Production Increase of Heavy Oils by Electromagnetic Heating," The Journal of Canadian Petroleum Technology, Jul.-Sep. 1976, pp. 91-97.
Sweeney, et al., "Study of Dielectric Properties of Dry and Saturated Green River Oil Shale," Lawrence Livermore National Laboratory, Mar. 26, 2007, revised manuscript Jun. 29, 2007, published on Web Aug. 25, 2007, pp. 1-9.
Kinzer, "Past, Present, and Pending Intellectual Property for Electromagnetic Heating of Oil Shale," Quasar Energy LLC, 28th Oil Shale Symposium Colorado School of Mines, Oct. 13-15, 2008, pp. 1-18.
Kinzer, "Past, Present, and Pending Intellectual Property for Electromagnetic Heating of Oil Shale," Quasar Energy LLC, 28th Oil Shale Symposium Colorado School of Mines, Oct. 13-15, 2008, pp. 1-33.
A. Godio: "Open ended-coaxial Cable Measurements of Saturated Sandy Soils", American Journal of Environmental Sciences, vol. 3, No. 3, 2007, XP002583544, pp. 175-182.
Carlson et al., "Development of the IIT Research Institute RF Heating Process for In Situ Oil Shale/Tar Sand Fuel Extraction—An Overview", Apr. 1981, pp. 1-9.

(56) References Cited

OTHER PUBLICATIONS

PCT International Search Report and Written Opinion in PCT/US2010/025763, dated Jun. 4, 2010, pp. 1-15.
PCT International Search Report and Written Opinion in PCT/US2010/025807, dated Jun. 17, 2010, pp. 1-15.
PCT International Search Report and Written Opinion in PCT/US2010/025804, dated Jun. 30, 2010, pp. 1-15.
PCT International Search Report and Written Opinion in PCT/US2010/025769, dated Jun. 10, 2010, pp. 1-15.
PCT International Search Report and Written Opinion in PCT/US2010/025765, dated Jun. 30, 2010, pp. 1-11.
PCT International Search Report and Written Opinion in PCT/US2010/025772, dated Aug. 9, 2010, pp. 1-16.
Butler, R.M. "Theoretical Studies on the Gravity Drainage of Heavy Oil During In-Situ Steam Heating", Can J. Chern Eng, vol. 59,1981, pp. 1-6.
Butler, R. and Mokrys, 1., "A New Process (VAPEX) for Recovering Heavy Oils Using Hot Water and Hydrocarbon Vapour", Journal of Canadian Petroleum Technology, 30(1 ), 1991, pp. 97-106.
Butler, R. and Mokrys, 1., "Recovery of Heavy Oils Using Vapourized Hydrocarbon Solvents: Further Development of the VAPEX Process", Journal of Canadian Petroleum Technology, 32(6), 1993, pp. 56-62.
Butler, R. and Mokrys, 1., "Closed Loop Extraction Method for the Recovery of Heavy Oils and Bitumens Underlain by Aquifers: the VAPEX Process", Journal of Canadian Petroleum Technology, 37(4), 1998, pp. 41-50.
Das, S.K. and Butler, R.M., "Extraction of Heavy Oil and Bitumen Using Solvents at Reservoir Pressure" CIM 95-118, presented at the CIM 1995 Annual Technical Conference in Calgary, Jun. 1995, pp. 1-16.
Das, S.K. and Butler, R.M., "Diffusion Coefficients of Propane and Butane in Peace River Bitumen" Canadian Journal of Chemical Engineering, 74,988-989, Dec. 1996 pp. 1-8.
Das, S.K. and Butler, R.M., "Mechanism of the Vapour Extraction Process for Heavy Oil and Bitumen", Journal of Petroleum Science and Engineering, 21, 1998, pp. 43-59.
Dunn, S.G., Nenniger, E. and Rajan, R., "A Study of Bitumen Recovery by Gravity Drainage Using Low Temperature Soluble Gas Injection", Canadian Journal of Chemical Engineering, 67, Dec. 1989, pp. 978-991.
Frauenfeld, T., Lillico, D., Jossy, C., Vilcsak, G., Rabeeh, S. and Singh, S., "Evaluation of Partially Miscible Processes for Alberta Heavy Oil Reservoirs", Journal of Canadian Petroleum Technology, 37(4), 1998, pp. 17-24.
Mokrys, 1., and Butler, R., "In Situ Upgrading of Heavy Oils and Bitumen by Propane Deasphalting: The VAPEX 11 Process", SPE 25452, presented at the SPE Production Operations Symposium held in Oklahoma City OK USA, D Mar. 21-23 1993, pp. 1-16.
Nenniger, J.E. and Dunn, S.G., "How Fast is Solvent Based Gravity Drainage?", CIPC 2008-139, presented at the Canadian International Petroleum Conference, held in Calgary, Alberta Canada, Jun. 17-19, 2008, pp. 1-14.
Nenniger, J.E. and Gunnewick, L., "Dew Point vs. Bubble Point: A Misunderstood Constraint on Gravity Drainage Processes", CIPC 2009-065, presented at the Canadian International Petroleum Conference, held in Calgary, Alberta D Canada, Jun. 16-18, 2009, pp. 1-16.
Bridges, J.E., Sresty, G.C., Spencer, H.L. and Wattenbarger, R.A., "Electromagnetic Stimulation of Heavy Oil Wells", 14, Third International Conference on Heavy Oil Crude and Tar Sands, UNITAR/UNDP, Long Beach D California, USA Jul. 22-31, 1985, pp. 1221-1232.
Carrizales, M.A., Lake, L.W. and Johns, R.T., "Production Improvement of Heavy Oil Recovery by Using Electromagnetic Heating", SPE115723, presented at the 2008 SPE Annual Technical Conference and Exhibition held in Denver, Colorado, USA, Sep. 21-24, 2008, p. 1.
Carrizales, M. and Lake, L.W., "Two-Dimensional COMSOL Simulation of Heavy-Oil Recovery by Electromagnetic Heating", Proceedings of the COMSOL Conference Boston, 2009, pp. 1-7.
Chakma, A. and Jha, K.N., "Heavy-Oil Recovery from Thin Pay Zones by Electromagnetic Heating", SPE24817, presented at the 67th Annual Technical Conference and Exhibition of the Society of Petroleum Engineers held in Washington, DC, Oct. 4-7, 1992, pp. 1-10.
Chhetri, A.B. and Islam, M.R., "A Critical Review of Electromagnetic Heating for Enhanced Oil Recovery", Petroleum Science and Technology, 26(14), 2008, pp. 1619-1631.
Kinzer, A Review of Notable Intellectual Property for In Situ Electromagnetic Heating of Oil Shale, Quasar Energy LLC, p. 1, 2009.

* cited by examiner

DISTILLED WATER PARTICLE SUSCEPTOR

RADIO FREQUENCY HEATING OF PETROLEUM ORE BY PARTICLE SUSCEPTORS

CROSS REFERENCE TO RELATED APPLICATIONS

This specification is related to the following patents, each of which is incorporated by reference herein: U.S. Pat. No. 8,887,810 issued Nov. 18, 2014; U.S. Pat. No. 8,674,274 issued Mar. 18, 2014; U.S. Pat. No. 8,101,068 issued Jan. 24, 2012; U.S. Pat. No. 8,133,384 issued Mar. 13, 2012; U.S. Pat. No. 8,494,775 issued Jul. 23, 2013; U.S. Pat. No. 8,729,440 issued May 20, 2014; U.S. Pat. No. 8,120,369 issued Feb. 21, 2012 and U.S. Pat. No. 8,128,786 issued Mar. 6, 2012.

FIELD OF THE INVENTION

The disclosure concerns a method for heating materials by application of radio frequency ("RF") energy, also known as electromagnetic energy. In particular, the disclosure concerns an advantageous method for RF heating of materials with a low or zero electric dissipation factor, magnetic dissipation factor, and electrical conductivity, such as petroleum ore. For example, the disclosure enables efficient, low-cost heating of bituminous ore, oil sands, oil shale, tar sands, or heavy oil.

Bituminous ore, oil sands, tar sands, and heavy oil are typically found as naturally occurring mixtures of sand or clay and dense and viscous petroleum. Recently, due to depletion of the world's oil reserves, higher oil prices, and increases in demand, efforts have been made to extract and refine these types of petroleum ore as an alternative petroleum source. Because of the extremely high viscosity of bituminous ore, oil sands, oil shale, tar sands, and heavy oil, however, the drilling and refinement methods used in extracting standard crude oil are typically not available. Therefore, bituminous ore, oil sands, oil shale, tar sands, and heavy oil are typically extracted by strip mining, or in situ techniques are used to reduce the viscosity of viscosity by injecting steam or solvents in a well so that the material can be pumped. Under either approach, however, the material extracted from these deposits can be a viscous, solid or semisolid form that does not easily flow at normal oil pipeline temperatures, making it difficult to transport to market and expensive to process into gasoline, diesel fuel, and other products. Typically, the material is prepared for transport by adding hot water and caustic soda (NaOH) to the sand, which produces a slurry that can be piped to the extraction plant, where it is agitated and crude bitumen oil froth is skimmed from the top. In addition, the material is typically processed with heat to separate oil sands, oil shale, tar sands, or heavy oil into more viscous bitumen crude oil, and to distill, crack, or refine the bitumen crude oil into usable petroleum products.

The conventional methods of heating bituminous ore, oil sands, tar sands, and heavy oil suffer from numerous drawbacks. For example, the conventional methods typically utilize large amounts of water, and also large amounts of energy. Moreover, using conventional methods, it has been difficult to achieve uniform and rapid heating, which has limited successful processing of bituminous ore, oil sands, oil shale, tar sands, and heavy oil. It can be desirable, both for environmental reasons and efficiency/cost reasons to reduce or eliminate the amount of water used in processing bituminous ore, oil sands, oil shale, tar sands, and heavy oil, and also provide a method of heating that is efficient and environmentally friendly, which is suitable for post-excavation processing of the bitumen, oil sands, oil shale, tar sands, and heavy oil.

One potential alternative heating method is RF heating. "RF" is most broadly defined here to include any portion of the electromagnetic spectrum having a longer wavelength than visible light. Wikipedia provides a definition of "radio frequency" as comprehending the range of from 3 Hz to 300 GHz, and defines the following sub ranges of frequencies:

| Name | Symbol | Frequency | Wavelength |
|---|---|---|---|
| Extremely low frequency | ELF | 3-30 Hz | 10,000-100,000 km |
| Super low frequency | SLF | 30-300 Hz | 1,000-10,000 km |
| Ultra low frequency | ULF | 300-3000 Hz | 100-1,000 km |
| Very low frequency | VLF | 3-30 kHz | 10-100 km |
| Low frequency | LF | 30-300 kHz | 1-10 km |
| Medium frequency | MF | 300-3000 kHz | 100-1000 m |
| High frequency | HF | 3-30 MHz | 10-100 m |
| Very high frequency | VHF | 30-300 MHz | 1-10 m |
| Ultra high frequency | UHF | 300-3000 MHz | 10-100 cm |
| Super high frequency | SHF | 3-30 GHz | 1-10 cm |
| Extremely high frequency | EHF | 30-300 GHz | 1-10 mm |

"RF heating," then, is most broadly defined here as the heating of a material, substance, or mixture by exposure to RF energy. For example, microwave ovens are a well-known example of RF heating.

The nature and suitability of RF heating depends on several factors. In general, most materials accept electromagnetic waves, but the degree to which RF heating occurs varies widely. RF heating is dependent on the frequency of the electromagnetic energy, intensity of the electromagnetic energy, proximity to the source of the electromagnetic energy, conductivity of the material to be heated, and whether the material to be heated is magnetic or non-magnetic. Pure hydrocarbon molecules are substantially nonconductive, of low dielectric loss factor and nearly zero magnetic moment. Thus, pure hydrocarbon molecules themselves are only fair susceptors for RF heating, e.g. they may heat only slowly in the presence of RF fields. For example, the dissipation factor D of aviation gasoline may be 0.0001 and distilled water 0.157 at 3 GHz, such that RF fields apply heat 1570 times faster to the water in emulsion to oil. ("Dielectric materials and Applications", A. R. Von Hippel Editor, John Wiley and Sons, New York, N.Y., 1954).

Thus far, RF heating has not been a suitable replacement for conventional processing methods of petroleum ore such as bituminous ore, oil sands, tar sands, and heavy oil. Dry petroleum ore itself does not heat well when exposed to RF energy. Dry petroleum ore possesses low dielectric dissipation factors ($\in''$), low (or zero) magnetic dissipation factors ($\mu''$), and low or zero conductivity. Moreover, while water may provide some susceptance at temperatures below 212° F. (100° C.), it is generally unsuitable as a susceptor at higher temperatures, and may be an undesirable additive to petroleum ore, for environmental, cost, and efficiency reasons.

SUMMARY OF THE INVENTION

An aspect of the present invention is a method for RF heating of materials with a low or zero dielectric dissipation factor, magnetic dissipation factor, and electrical conductivity. For example, the present invention may be used for RF heating of petroleum ore, such as bituminous ore, oil sands, tar sands, oil shale, or heavy oil. An exemplary embodiment of the present method comprises first mixing about 10% to about 99% by volume of a substance such as petroleum ore with about 1% to about 50% by volume of a substance comprising susceptor particles. The mixture is then subjected to a radio frequency in a manner which creates heating of the susceptor particles. The radio frequency can be applied for a sufficient time to allow the susceptor particles to heat the surrounding substance through conduction, so that the average temperature of the mixture can be greater than about 212° F. (100° C.). After the mixture has achieved the desired temperature, the radio frequency can be discontinued, and substantially all of the susceptor particles can optionally be removed, resulting in a heated substance that can be substantially free of the susceptor particles used in the RF heating process.

Other aspects of the invention will be apparent from this disclosure.

DETAILED DESCRIPTION OF THE PREFERRED EMBODIMENTS

Figure 1:
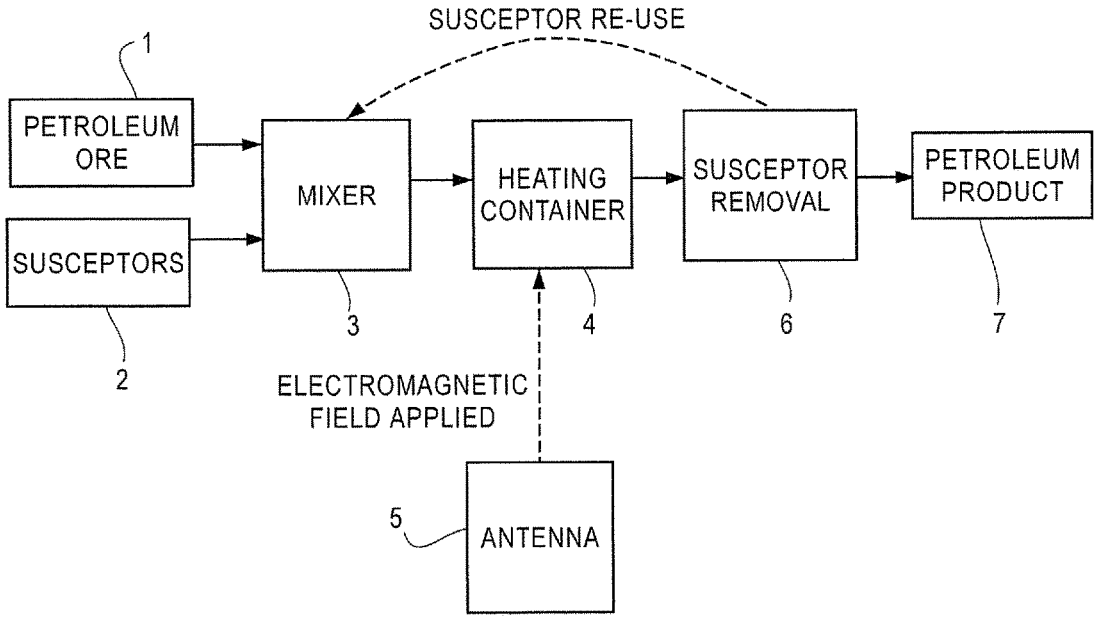
FIG. 1 is a flow diagram depicting a process and equipment for RF heating of a petroleum ore using susceptor particles.

The subject matter of this disclosure will now be described more fully, and one or more embodiments of the invention are shown. This invention may, however, be embodied in many different forms and should not be construed as limited to the embodiments set forth herein. Rather, these embodiments are examples of the invention, which has the full scope indicated by the language of the claims.

In an exemplary method, a method for heating a petroleum ore such as bituminous ore, oil sands, tar sands, oil shale, or heavy oil using RF energy is provided.

Petroleum Ore

The presently disclosed method can be utilized to either heat a petroleum ore that has been extracted from the earth, prior to distillation, cracking, or separation processing, or can be used as part of a distillation, cracking, or separation process. The petroleum ore can comprise, for example, bituminous ore, oil sands, tar sands, oil shale, or heavy oil that has been extracted via strip-mining or drilling. If the extracted petroleum ore is a solid or includes solids with a volume greater than about 1 cubic centimeter, the petroleum ore can be crushed, ground, or milled to a slurry, powder, or small-particulate state prior to RF heating. The petroleum ore can comprise water, but alternatively contains less than 10%, less than 5%, or less than 1% by volume of water. Most preferably, the petroleum ore can be substantially free of added water.

The petroleum ore used in the present method is typically non-magnetic or low-magnetic, and non-conductive or low-conductive. Therefore, the petroleum ore alone is not generally suitable for RF heating. For example, exemplary petroleum ore when dry, e.g. free from water, may have a dielectric dissipation factor ($\in''$) less than about 0.01, 0.001, or 0.0001 at 3000 MHz. Exemplary petroleum ore may also have a negligible magnetic dissipation factor ($\mu''$), and the exemplary petroleum ore may also have an electrical conductivity of less than 0.01, 0.001, or 0.0001 $S \cdot m^{-1}$ at 20° C. The presently disclosed methods, however, are not limited to petroleum products with any specific magnetic or conductive properties, and can be useful to RF heat substances with a higher dielectric dissipation factors ($\in''$), magnetic dissipation factor ($\mu''$), or electrical conductivity. The presently disclosed methods are also not limited to petroleum ore, but are widely applicable to RF heating of any substance that has dielectric dissipation factor ($\in''$) less than about 0.05, 0.01, or 0.001 at 3000 MHz. It is also applicable to RF heating of any substance that has have a negligible magnetic dissipation factor ($\mu''$), or an electrical conductivity of less than 0.01 $S \cdot m^{-1}$, $1 \times 10^{-4}$ or $1 \times 10^{-6}$ $S \cdot m^{-1}$ at 20° C.

Susceptor Particles

The presently disclosed method utilizes one or more susceptor materials in conjunction with the petroleum ore to provide improved RF heating. A "susceptor" is herein defined as any material which absorbs electromagnetic energy and transforms it to heat. Susceptors have been suggested for applications such as microwave food packing, thin-films, thermosetting adhesives, RF-absorbing polymers, and heat-shrinkable tubing. Examples of susceptor materials are disclosed in U.S. Pat. Nos. 5,378,879; 6,649,888; 6,045,648; 6,348,679; and 4,892,782, which are incorporated by reference herein.

In the presently disclosed method, the one or more susceptors are for example in the form of susceptor particles. The susceptor particles can be provided as a powder, granular substance, flakes, fibers, beads, chips, colloidal suspension, or in any other suitable form whereby the average volume of the susceptor particles can be less than about 10 cubic mm. For example, the average volume of the susceptor particles can be less than about 5 cubic mm, 1 cubic mm, or 0.5 cubic mm. Alternatively, the average volume of the susceptor particles can be less than about 0.1 cubic mm, 0.01 cubic mm, or 0.001 cubic mm. For example, the susceptor particles can be nanoparticles with an average particle volume from $1 \times 10^{-9}$ cubic mm to $1 \times 10^{-6}$ cubic mm, $1 \times 10^{-7}$ cubic mm, or $1 \times 10^{8}$ cubic mm.

Depending on the preferred RF heating mode, the susceptor particles can comprise conductive particles, magnetic particles, or polar material particles. Exemplary conductive particles include metal, powdered iron (pentacarbonyl E iron), iron oxide, or powdered graphite. Exemplary magnetic materials include ferromagnetic materials include iron, nickel, cobalt, iron alloys, nickel alloys, cobalt alloys, and steel, or ferrimagnetic materials such as magnetite, nickel-zinc ferrite, manganese-zinc ferrite, and copper-zinc ferrite. Exemplary polar materials include butyl rubber (such as ground tires), barium titanate powder, aluminum oxide powder, or PVC flour.

Mixing of Petroleum Ore and Susceptor Particles

Preferably, a mixing or dispersion step is provided, whereby a composition comprising the susceptor particles is mixed or dispersed in the petroleum ore. The mixing step can occur after the petroleum ore has been crushed, ground, or milled, or in conjunction with the crushing, grinding, or milling of the petroleum ore. The mixing step can be conducted using any suitable method or apparatus that disperses the susceptor particles in a substantially uniform manner. For example, a sand mill, cement mixer, continuous soil mixer, or similar equipment can be used.

An advantageous capability of the presently disclosed methods can be the fact that large amounts of susceptor particles can optionally be used without negatively affecting the chemical or material properties of the processed petroleum ore. Therefore, a composition comprising susceptor particles can for example be mixed with the petroleum ore in amount from about 1% to about 50% by volume of the total mixture. Alternatively, the composition comprising susceptor particles comprises from about 1% to about 25% by volume of the total mixture, or about 1% to about 10% by volume of the total mixture.

Radio Frequency Heating

After the susceptor particle composition has been mixed in the petroleum ore, the mixture can be heated using RF energy. An RF source can be provided which applies RF energy to cause the susceptor particles to generate heat. The heat generated by the susceptor particles causes the overall mixture to heat by conduction. The preferred RF frequency, power, and source proximity vary in different embodiments depending on the properties of the petroleum ore, the susceptor particle selected, and the desired mode of RF heating.

In one exemplary embodiment, RF energy can be applied in a manner that causes the susceptor particles to heat by induction. Induction heating involves applying an RF field to electrically conducting materials to create electromagnetic induction. An eddy current is created when an electrically conducting material is exposed to a changing magnetic field due to relative motion of the field source and conductor; or due to variations of the field with time. This can cause a circulating flow or current of electrons within the conductor. These circulating eddies of current create electromagnets with magnetic fields that opposes the change of the magnetic field according to Lenz's law. These eddy currents generate heat. The degree of heat generated in turn, depends on the strength of the RF field, the electrical conductivity of the heated material, and the change rate of the RF field. There can be also a relationship between the frequency of the RF field and the depth to which it penetrate the material; in general, higher RF frequencies generate a higher heat rate.

Induction RF heating can be for example carried out using conductive susceptor particles. Exemplary susceptors for induction RF heating include powdered metal, powdered iron (pentacarbonyl E iron), iron oxide, or powdered graphite. The RF source used for induction RF heating can be for example a loop antenna or magnetic near-field applicator suitable for generation of a magnetic field. The RF source typically comprises an electromagnet through which a high-frequency alternating current (AC) is passed. For example, the RF source can comprise an induction heating coil, a chamber or container containing a loop antenna, or a magnetic near-field applicator. The exemplary RF frequency for induction RF heating can be from about 50 Hz to about 3 GHz. Alternatively, the RF frequency can be from about 10 kHz to about 10 MHz, 10 MHz to about 100 MHZ, or 100 MHz to about 2.5 GHz. The power of the RF energy, as radiated from the RF source, can be for example from about 100 KW to about 2.5 MW, alternatively from about 500 KW to about 1 MW, and alternatively, about 1 MW to about 2.5 MW.

In another exemplary embodiment, RF energy can be applied in a manner that causes the susceptor particles to heat by magnetic moment heating, also known as hysteresis heating. Magnetic moment heating is a form of induction RF heating, whereby heat is generated by a magnetic material. Applying a magnetic field to a magnetic material induces electron spin realignment, which results in heat generation. Magnetic materials are easier to induction heat than non-magnetic materials, because magnetic materials resist the rapidly changing magnetic fields of the RF source. The electron spin realignment of the magnetic material produces hysteresis heating in addition to eddy current heating. A metal which offers high resistance has high magnetic permeability from 100 to 500; non-magnetic materials have a permeability of 1. One advantage of magnetic moment heating can be that it can be self-regulating. Magnetic moment heating only occurs at temperatures below the Curie point of the magnetic material, the temperature at which the magnetic material loses its magnetic properties.

Magnetic moment RF heating can be performed using magnetic susceptor particles. Exemplary susceptors for magnetic moment RF heating include ferromagnetic materials or ferrimagnetic materials. Exemplary ferromagnetic materials include iron, nickel, cobalt, iron alloys, nickel alloys, cobalt alloys, and steel. Exemplary ferrimagnetic materials include magnetite, nickel-zinc ferrite, manganese-zinc ferrite, and copper-zinc ferrite. In certain embodiments, the RF source used for magnetic moment RF heating can be the same as that used for induction heating—a loop antenna or magnetic near-field applicator suitable for generation of a magnetic field, such as an induction heating coil, a chamber or container containing a loop antenna, or a magnetic near-field applicator. The exemplary RF frequency for magnetic moment RF heating can be from about 100 kHz to about 3 GHz. Alternatively, the RF frequency can be from about 10 kHz to about 10 MHz, 10 MHz to about 100 MHZ, or 100 MHz to about 2.5 GHz. The power of the RF energy, as radiated from the RF source, can be for example from about 100 KW to about 2.5 MW, alternatively from about 500 KW to about 1 MW, and alternatively, about 1 MW to about 2.5 MW.

In a further exemplary embodiment, the RF energy source and susceptor particles selected can result in dielectric heating. Dielectric heating involves the heating of electrically insulating materials by dielectric loss. Voltage across a dielectric material causes energy to be dissipated as the molecules attempt to line up with the continuously changing electric field.

Dielectric RF heating can be for example performed using polar, non-conductive susceptor particles. Exemplary susceptors for dielectric heating include butyl rubber (such as ground tires), barium titanate, aluminum oxide, or PVC. Water can also be used as a dielectric RF susceptor, but due to environmental, cost, and processing concerns, in certain embodiments it may be desirable to limit or even exclude water in processing of petroleum ore. Dielectric RF heating typically utilizes higher RF frequencies than those used for induction RF heating. At frequencies above 100 MHz an electromagnetic wave can be launched from a small dimension emitter and conveyed through space. The material to be heated can therefore be placed in the path of the waves, without a need for electrical contacts. For example, domestic microwave ovens principally operate through dielectric heating, whereby the RF frequency applied is about 2.45 GHz. The RF source used for dielectric RF heating can be for example a dipole antenna or electric near field applicator. An exemplary RF frequency for dielectric RF heating can be from about 100 MHz to about 3 GHz. Alternatively, the RF frequency can be from about 500 MHz to about 3 GHz. Alternatively, the RF frequency can be from about 2 GHz to about 3 GHz. The power of the RF energy, as radiated from the RF source, can be for example from about 100 KW to about 2.5 MW, alternatively from about 500 KW to about 1 MW, and alternatively, about 1 MW to about 2.5 MW.

The reflection of incident RF energy such as an incident electromagnetic wave can reduce the effectiveness of RF heating. It may be desirable for the RF fields or electromagnetic waves to enter the materials and susceptors to dissipate. Thus, in one embodiment the susceptor particles can have the property of equal permeability and permittivity, e.g. $\mu r = \in r$ to eliminate wave reflections at an air-susceptor interfaces. This can be explained as follows: wave reflections occur according to the change in characteristic impedance at the material interfaces: mathematically $r=(Z1-Z2)/(Z1+Z2)$ where r is the reflection coefficient and Z1 and Z1 are the characteristic or wave impedances of the individual materials 1 and 2. Whenever Z1=Z2 zero reflection occurs. As the characteristic wave impedance of a material is $Z=120\pi\ (\sqrt{\mu r/\in r})$, whenever $\mu r=\in r$, $Z=120\pi=377$ ohms. In turn, there would be no wave reflection for that material at an air interface, as air is also Z=377 ohms. An example of a isoimpedance magnetodielectric ($\mu r\ \in r$) susceptor material, without reflection to air, is light nickel zinc ferrite which can have $\mu r=\in r=14$. As background, other than refractive properties, nonconductive materials of $\mu r \equiv \in r$ may be invisible in the electromagnetic spectrum where this occurs. With sufficient conductivity, $\mu r \equiv \in r$ susceptor materials have excellent RF heating properties for high speed and efficiency.

The susceptor particles may be proportioned in the hydrocarbon ore to obtain $\mu_r \equiv \in_r$ from the mixture overall, for reduced reflections at air interface and increased heating speed. The logarithmic mixing formula $\log \in_m' = \theta_1 \log \in_1' + \theta_2 \log \in_2'$ may be used to adjust the permittivity of the mixture overall by the volume ratios e of the components and the permittivities $\in$ of components, 1 and 2. In the case of semiconducting susceptor particles the size, shape, and distribution of particles may however affect the material polarizability and some empiricism may be required. The paper "The Properties Of A Dielectric Containing Semiconducting Particles Of Various Shapes", R. W. Sillars, Journal of The Institution Of Electrical Engineers (Great Britain), Vol. 80, April 1937, No. 484 may also be consulted.

In another embodiment of the present invention, pentacarbonyl E iron powder is advantageous as a magnetic (H) field susceptor. In the pentacarbonyl, E iron powder embodiment, iron susceptor powder particles in the 2 to 8 micron range are utilized. A specific manufacture is type EW (mechanically hard CIP grade, silicated 97.0% Fe, 3 um avg. particle size) by BASF Corporation, Ludwigshafen, Germany (www.inorganics.BASF.com). This powder may also be produced by GAF Corporation at times in the United States. Irrespective of manufacture, sufficiently small bare iron particles (EQ) are washed in 75 percent phosphoric acid ("Ospho" by Marine Enterprises Inc.) to provide an insulative oxide outer finish, $FePO_4$. In other words, the susceptor particles may be conductive susceptor particles having an insulative coating. The iron powder susceptors have a low conductivity together in bulk and small particle size such that RF magnetic fields are penetrative. The susceptor powder particles must be small relative the radio frequency skin depth, e.g. particle diameter $d<\sqrt{(\lambda/\pi\sigma\mu c)}$ where wavelength is the wavelength in air, $\sigma$ is conductivity of iron, $\mu$ is the permeability of the iron, and c is the speed of light.

The susceptor particles need not be solids, and in another embodiment liquid water may be used. The water can be mixed with or suspended in emulsion with the petroleum ore. The dissipation factor of pure, distilled water is provided as FIG. 3, although particles can modify effective loss tangent due to polarization effects. As can be appreciated water molecules may have insufficient dissipation in the VHF (30 to 300 MHz) region. The use of sodium hydroxide (lye) is specifically therefore identified as a means of enhancing the dissipation of water for use as a RF susceptor. In general, the hydronium ion content of water ($OH^-$) can be varied need with salts, acids and bases, etc to modify loss characteristics. Water is most useful between 0 and 100 C as ice and steam have greatly reduced susceptance, e.g. they may not heat appreciably as indicated by the critical points on Mollier diagrams.

In yet another embodiment, the RF energy source used can be far-field RF energy, and the susceptor particles selected act as mini-dipole antennas that generate heat. One property of a dipole antenna is that it can convert RF waves to electrical current. The material of the dipole antenna, therefore, can be selected such that it resistively heats under an electrical current. Mini-dipole RF heating can be preferably performed using carbon fiber, carbon fiber floc, or carbon fiber cloth (e.g., carbon fiber squares) susceptors. Carbon fibers or carbon fiber floc preferably are less than 5 cm long and less than 0.5 MW.

In each of the presently exemplary embodiments, RF energy can be applied for a sufficient time to allow the heated susceptor particles to heat the surrounding hydrocarbon oil, ore, or sand. For example, RF energy can be applied for sufficient time so that the average temperature of the mixture can be greater than about 212° F. (100° C.). Alternatively, RF energy can be applied until the average temperature of the mixture is, for example, greater than 300° F. (150° C.), or 400° F. (200° C.). Alternatively, RF energy can be applied until the average temperature of the mixture is, for example, greater than 700° F. (400° C.). In a variation on the exemplary embodiment the RF energy can be applied as part of a distillation or cracking process, whereby the mixture can be heated above the pyrolysis temperature of the hydrocarbon in order to break complex molecules such as kerogens or heavy hydrocarbons into simpler molecules (e.g. light hydrocarbons). It is presently believed that the suitable length of time for application of RF energy in the presently disclosed embodiments can be preferably from about 15 seconds, 30 seconds, or 1 minute to about 10 minutes, 30 minutes, or 1 hour. After the hydrocarbon/susceptor mixture has achieved the desired average temperature, exposure of the mixture to the radio frequency can be discontinued. For example, the RF source can be turned off or halted, or the mixture can be removed from the RF source.

Removal/Reuse of Susceptor Particles

In certain embodiments, the present disclosure also contemplates the ability to remove the susceptor particles after the hydrocarbon/susceptor mixture has achieved the desired average temperature.

If the susceptor particles are left in the mixture, in certain embodiments this may undesirably alter the chemical and material properties of primary substance. One alternative is to use a low volume fraction of susceptor, if any. For example, U.S. Pat. No. 5,378,879 describes the use of permanent susceptors in finished articles, such as heat-shrinkable tubing, thermosetting adhesives, and gels, and states that articles loaded with particle percentages above 15% are generally not preferred, and in fact, are achievable in the context of that patent only by using susceptors having relatively lower aspect ratios. The present disclosure provides the alternative of removing the susceptors after RF heating. By providing the option of removing the susceptors after RF heating, the present disclosure can reduce or eliminate undesirable altering of the chemical or material properties of the petroleum ore, while allowing a large volume fraction of susceptors to be used. The susceptor particle composition can thus function as a temporary heating substance, as opposed to a permanent additive.

Removal of the susceptor particle composition can vary depending on the type of susceptor particles used and the consistency, viscocity, or average particle size of the mixture. If necessary or desirable, removal of the susceptor particles can be performed in conjunction with an additional mixing step. If a magnetic or conductive susceptor particle is used, substantially all of the susceptor particles can be removed with one or more magnets, such as quiescent or direct-current magnets. In the case of a polar dielectric susceptor, substantially all of the susceptor particles can be removed through flotation or centrifuging. Carbon fiber, carbon floc, or carbon fiber cloth susceptors can be removed through flotation, centrifuging, or filtering. For example, removal of the susceptor particles can be performed either while the petroleum ore/susceptor mixture is still being RF heated, or within a sufficient time after RF heating has been stopped so that the temperature of the petroleum ore decreases by no more than 30%, and alternatively, no more than 10%. For example, it is exemplary that the petroleum ore maintain an average temperature of greater than 200° F. (93° C.) during any removal of the susceptor particles, alternatively an average temperature of greater than 200° F. (93° C.).

Another advantage of the exemplary embodiments of the present disclosure can be that the susceptor particles can optionally be reused after they are removed from a heated mixture.

Alternatively, in certain instances it may be appropriate to leave some or all of the susceptor particles in some or all of the material of the mixture after processing. For example, if the particles are elemental carbon, which is non-hazardous and inexpensive, it may be useful to leave the particles in the mixture after heating, to avoid the cost of removal. For another example, a petroleum ore with added susceptor material can be pyrolyzed to drive off useful lighter fractions of petroleum, which are collected in vapor form essentially free of the susceptor material, while the bottoms remaining after pyrolysis may contain the susceptor and be used or disposed of without removing the susceptor.

Referring to FIG. 1, a flow diagram of an embodiment of the present disclosure is provided. A container 1 is included, which contains a first substance with a dielectric dissipation factor, epsilon, less than 0.05 at 3000 MHz. The first substance, for example, may comprise a petroleum ore, such as bituminous ore, oil sand, tar sand, oil shale, or heavy oil. A container 2 contains a second substance comprising susceptor particles. The susceptors particles may comprise any of the susceptor particles discussed herein, such as powdered metal, powdered metal oxide, powdered graphite, nickel zinc ferrite, butyl rubber, barium titanate powder, aluminum oxide powder, or PVC flour. A mixer 3 is provided for dispersing the second susceptor particle substance into the first substance. The mixer 3 may comprise any suitable mixer for mixing viscous substances, soil, or petroleum ore, such as a sand mill, soil mixer, or the like. The mixer may be separate from container 1 or container 2, or the mixer may be part of container 1 or container 2. A heating vessel 4 is also provided for containing a mixture of the first substance and the second substance during heating. The heating vessel may also be separate from the mixer 3, container 1, and container 2, or it may be part of any or all of those components. Further, an antenna 5 is provided, which is capable of emitting electromagnetic energy as described herein to heat the mixture. The antenna 5 may be a separate component positioned above, below, or adjacent to the heating vessel 4, or it may comprise part of the heating vessel 4. Optionally, a further component, susceptor particle removal component 6 may be provided, which is capable of removing substantially all of the second substance comprising susceptor particles from the first substance. Susceptor particle removal component 6 may comprise, for example, a magnet, centrifuge, or filter capable of removing the susceptor particles. Removed susceptor particles may then be optionally reused in the mixer, while a heated petroleum product 7 may be stored or transported.

Figure 2:
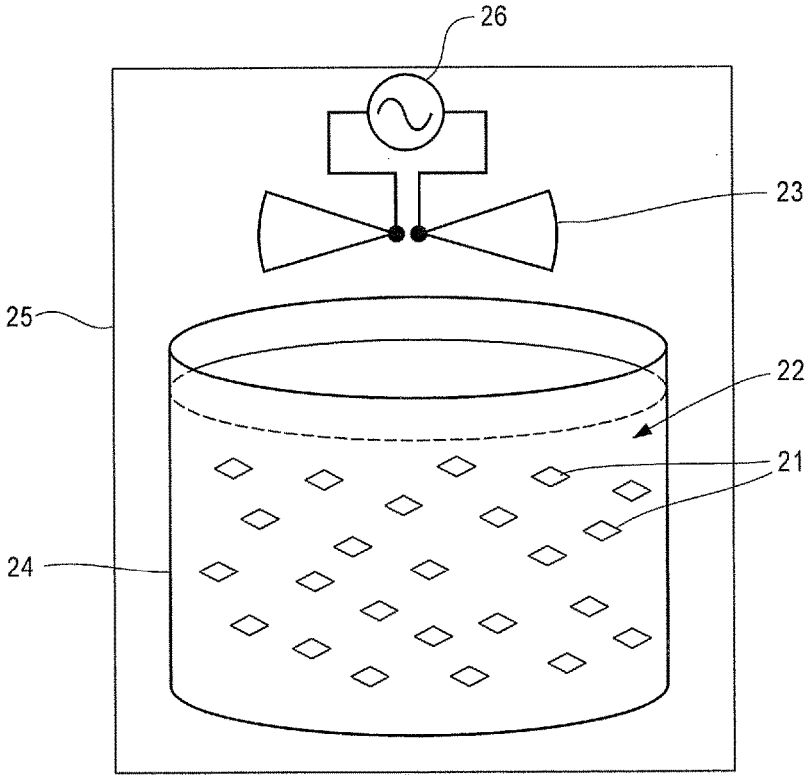
FIG. 2 illustrates susceptor particles distributed in a petroleum ore (not to scale), with associated RF equipment.

Referring to FIG. 2, a petroleum ore including an exemplar heating vessel is described. Susceptor particles 210 are distributed in petroleum ore 220. The susceptor particles may comprise any of the above-discussed susceptor particles, such as conductive, dielectric, or magnetic particles. The petroleum ore 220 may contain any concentration of hydrocarbon molecules, which themselves may not be suitable susceptors for RF heating. An antenna 230 is placed in sufficient proximity to the mixture of susceptor particles 210 and petroleum ore 220 to cause heating therein, which may be near field or far field or both. The antenna 230 may be a bowtie dipole although the invention is not so limited, and any form for antenna may be suitable depending on the trades. A vessel 240 may be employed, which may take the form of a tank, a separation cone, or even a pipeline. A method for stirring the mixture may be employed, such as a pump (not shown). Vessel 240 may omitted in some applications, such as heating dry ore on a conveyor. RF shielding 250 can be employed as is common. Transmitting equipment 260 produces the time harmonic, e.g. RF, current for antenna 230. The transmitting equipment 260 may contain the various RF transmitting equipment features such as impedance matching equipment (not shown), variable RF couplers (not shown), and control systems (not shown), and other such features.

Figure 3:
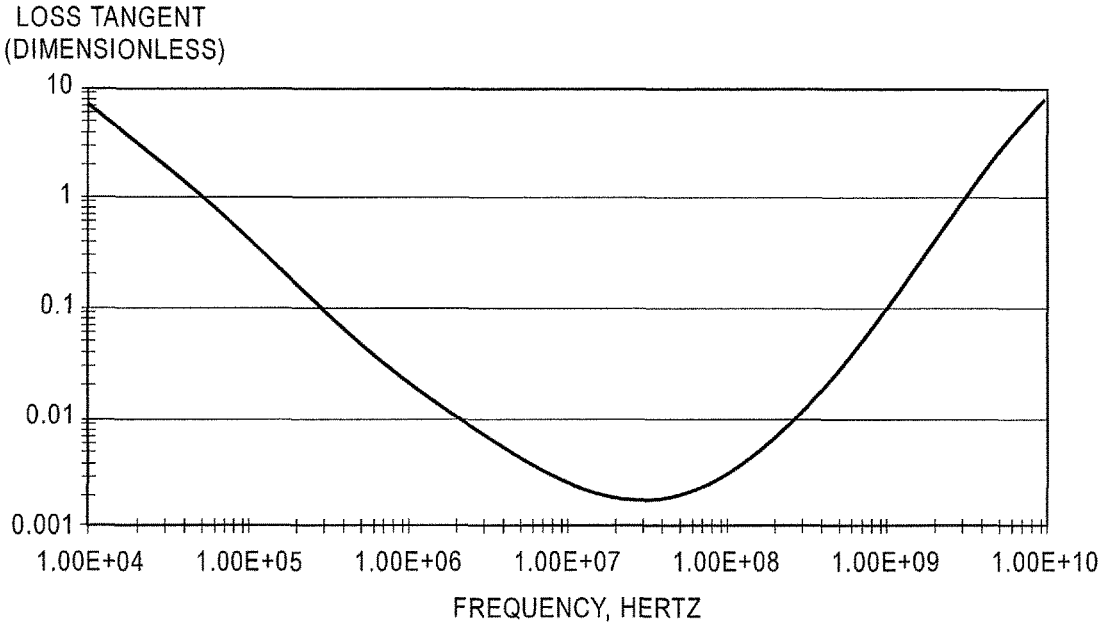
FIG. 3 is a graph of the dissipation factor of water as a function of frequency versus loss tangent.

Referring to FIG. 3, the dissipation factor of pure, distilled water is provided, although particles can modify effective loss tangent due to polarization effects. As can be appreciated water molecules may have insufficient dissipation in the VHF (30 to 300 MHz) region.

EXAMPLES

The following examples illustrate several of the exemplary embodiments of the present disclosure. The examples are provided as small-scale laboratory confirmation examples. However, one of ordinary skill in the art will appreciate, based on the foregoing detailed description, how to conduct the following exemplary methods on an industrial scale.

Example 1: RF Heating of Petroleum Ore without Particle Susceptors

A sample of ¼ cup of Athabasca oil sand was obtained at an average temperature of 72° F. (22° C.). The sample was contained in a Pyrex glass container. A GE DE68-0307A microwave oven was used to heat the sample at 1 KW at 2450 MHz for 30 seconds (100% power for the microwave oven). The resulting average temperature after heating was 125° F. (51° C.).

Example 2: RF Heating of Petroleum Ore with Magnetic Particle Susceptors

A sample of ¼ cup of Athabasca oil sand was obtained at an average temperature of 72° F. (22° C.). The sample was contained in a Pyrex glass container. 1 Tablespoon of nickel zinc ferrite nanopowder (PPT #FP350 CAS 1309-31-1) at an average temperature of 72° F. (22° C.) was added to the Athabasca oil sand and uniformly mixed. A GE DE68-0307A microwave oven was used to heat the mixture at 1 KW at 2450 MHz for 30 seconds (100% power for the microwave oven). The resulting average temperature of the mixture after heating was 196° F. (91° C.).

Example 3: (Hypothetical Example) RF Heating of Petroleum Ore with Conductive Susceptors A sample of ¼ cup of Athabasca oil sand is obtained at an average temperature of 72° F. (22° C.). The sample is contained in a Pyrex glass container. 1 Tablespoon of powdered pentacarbonyl E iron at an average temperature of 72° F. (22° C.) is added to the Athabasca oil sand and uniformly mixed. A GE DE68-0307A microwave oven is used to heat the mixture at 1 KW at 2450 MHz for 30 seconds (100% power for the microwave oven). The resulting average temperature of the mixture after heating will be greater than the resulting average temperature achieved using the method of Example 1.

Example 4: (Hypothetical Example) RF Heating of Petroleum Ore with Polar Susceptors A sample of ¼ cup of Athabasca oil sand is obtained at an average temperature of 72° F. (22° C.). The sample is contained in a Pyrex glass container. 1 Tablespoon of butyl rubber (such as ground tire rubber) at an average temperature of 72° F. (22° C.) is added to the Athabasca oil sand and uniformly mixed. A GE DE68-0307A microwave oven is used to heat the mixture at 1 KW at 2450 MHz for 30 seconds (100% power for the microwave oven). The resulting average temperature of the mixture after heating will be greater than the resulting average temperature achieved using the method of Example 1.

The invention claimed is:

1. A method for heating a petroleum ore comprising:

(a) providing a mixture of about 10% to about 99% by volume of the petroleum ore and about 1% to about 50% by volume of a composition comprising ferrite susceptor particles, the ferrite susceptor particles having an electrical conductivity greater than $1\times10^7$ S/m at 20° C.;

(b) applying a magnetic field to the mixture at a power and frequency sufficient to heat the ferrite susceptor particles; and (c) continuing to apply the magnetic field for a sufficient time to allow the ferrite susceptor particles to heat the mixture to an average temperature greater than about 212° F. (100° C.).

2. The method of claim 1, further comprising removing the ferrite susceptor particles from the petroleum ore.

3. A method for heating a petroleum ore comprising:

(a) providing a mixture of about 10% to about 99% by volume of the petroleum ore and about 1% to about 50% by volume of a composition comprising ferrite susceptor particles, the ferrite susceptor particles having equal permittivity and permeability;

(b) applying a magnetic field to the mixture at a power and frequency sufficient to heat the ferrite susceptor particles; and (c) continuing to apply the magnetic field for a sufficient time to allow the ferrite susceptor particles to heat the mixture to an average temperature greater than about 212° F. (100° C.).

4. The method of claim 3, further comprising removing the ferrite susceptor particles from the petroleum ore.

5. The method of claim 3, wherein the ferrite susceptor particles have an electrical conductivity greater than $1\times10^7$ S/m at 20° C.

6. The method of claim 3, wherein the petroleum ore comprises at least one of bituminous ore, oil sand, tar sand, oil shale, and heavy oil.

7. The method of claim 3, wherein the average size of the ferrite susceptor particles is less than 1 cubic mm.

8. The method of claim 3, wherein the mixture of step (a) comprises from about 70% to about 90% by weight of petroleum ore and from about 30% to about 10% by weight of the ferrite susceptor particles.

9. The method of claim 3, wherein the mixture is heated to above 400° F. (204° C.).

10. The method of claim 3, wherein the mixture comprises at least one of powder, granular substance, slurry, and viscous liquid.

11. A method for heating comprising:

(a) providing a first substance with a dielectric dissipation factor, epsilon, less than 0.05 at 3000 MHz;

(b) adding a second substance comprising ferrite susceptor particles and with an average volume of less than 1 cubic mm to create a dispersed mixture, wherein the second substance comprises between about 1% to about 40% by volume of the mixture, and wherein the ferrite susceptor particles have an electrical conductivity greater than $1\times10^7$ S/m at 20° C.;

(c) applying a magnetic field at a power and frequency sufficient to heat the ferrite susceptor particles;

(d) continuing to apply the magnetic field for a sufficient time to allow the ferrite susceptor particles to heat the mixture to an average temperature of greater than 212° F. (100° C.); and (e) removing the ferrite susceptor particles.

12. The method of claim 11, wherein the ferrite susceptor particles are removed using at least one of: magnets, centrifuging, filtering, and floating the ferrite susceptor particles.

13. The method of claim 1, further comprising subsequently removing the ferrite susceptor particles from the petroleum ore.

14. The method of claim 1, wherein the petroleum ore comprises at least one of bituminous ore, oil sand, tar sand, oil shale, and heavy oil.

15. The method of claim 1, wherein the average size of the ferrite susceptor particles is less than 1 cubic mm.

16. The method of claim 1, wherein the mixture of step (a) comprises from about 70% to about 90% by weight of petroleum ore and from about 30% to about 10% by weight of the ferrite susceptor particles.

17. The method of claim 1, wherein the mixture is heated to above 400° F. (204° C.).

18. The method of claim 1, wherein the mixture comprises at least one of powder, granular substance, slurry, and viscous liquid.

* * * * *